US005481893A

United States Patent [19]

Barjasteh et al.

[11] Patent Number: 5,481,893

[45] Date of Patent: Jan. 9, 1996

[54] APPARATUS FOR HOSE CRIMPING MACHINE

[75] Inventors: Michael M. Barjasteh, Rockaway, N.J.; Jerry Umbra, Rhinebeck, N.Y.; Ali M. Sadegh, Closter, N.J.

[73] Assignee: Mastercool USA, Inc., Rockaway, N.J.

[21] Appl. No.: 185,559

[22] Filed: Jan. 24, 1994

[51] Int. Cl.[6] ..... B21D 15/00; B21D 17/04

[52] U.S. Cl. ..... 72/107; 72/121; 72/110

[58] Field of Search ..... 492/30; 29/237, 29/283.5, 508, 516, 517, 788, 796; 72/80, 107, 108, 110, 121, 126

[56] References Cited

U.S. PATENT DOCUMENTS

| | | | |
|---|---|---|---|
| 2,469,426 | 5/1949 | Anthony | 72/107 |
| 2,813,442 | 11/1957 | Wingate | 29/508 |
| 3,052,278 | 9/1962 | Baluck et al. | 72/107 |
| 3,689,112 | 9/1972 | Slator et al. | 29/516 |
| 3,895,177 | 7/1975 | Muslin | 72/80 |
| 4,192,171 | 3/1980 | Hamilton . | |
| 4,305,190 | 12/1981 | Flair | 72/107 |
| 5,257,525 | 11/1993 | Clarke . | |

*Primary Examiner*—Lowell A. Larson
*Assistant Examiner*—Rodney Butler
*Attorney, Agent, or Firm*—Mathews, Woodbridge & Collins

[57] ABSTRACT

An apparatus is provided for crimping fittings to hose assemblies. A pair of drive rollers are used for rotating a fitting. A pair of deflector rollers are positioned opposite of the drive rollers. A fitting and hose assembly is placed between the drive rollers and the deflector rollers. The deflector rollers and the drive rollers include a raised portion for producing a crimp in the fitting, thereby expeditiously securing the fitting to the hose and providing a leakproof connection.

17 Claims, 10 Drawing Sheets

APPARATUS FOR HOSE CRIMPING MACHINE

BACKGROUND OF THE INVENTION

1. Field of the Invention

This invention relates to an apparatus for crimping fittings to hose assemblies.

2. Description of the Related Art

Conventional refrigeration systems circulate a refrigerant through a closed cooling system. In this circulation process, the refrigerant changes states between a fluid and a gas. Freon has been used as a refrigerant. Freon consists of dichlorofluorocarbons, such as dichlorodifluoromethane. Conventional freon is designated under ANSI Code B79.1-1968 as Freon 12, R-12 or Genetron 12. It has been found that the release of halogen refrigerants into the atmosphere deleteriously affects the ozone layer which surrounds and protects the earth from ultraviolet solar radiation.

The Environmental Protection Agency mandated the use of a refrigerant described as R-134a systems or HCF 134 systems to minimize ozone depletion. The R-134 refrigerant system replaces the dichloride in the refrigerant with hydrogen for minimizing the release of halogens into the atmosphere. Although the R-134 refrigerant is less harmful than freon to the environment, the EPA still recommends that the R-134 refrigerant should not be released to the atmosphere. The R-134 refrigerant is typically recycled by a closed system which is defined as a "refrigerant recycling machine".

Conventional fittings, adapters or couplers have been used for connecting and disconnecting refrigerant recycling machines to the tubular high or low-sides of air conditioning systems. Conventional hoses, couplers and ports have been used with R-12 refrigerant systems. Recently, the Society of Automotive Engineers (SAE), Environmental Protection Agency (EPA), and Automotive manufacturers mandated the retrofitting of all the hoses and fittings from the R-12 standards to R-134a standards. This requires performing hose make-up or repair on hose assemblies for R-134a systems.

Crimping devices have been used to crimp a fitting onto a hose. U.S. Pat. No. 4,192,171 describes a hand held crimping tool including a pair of crimping dies. Each die has a concave face and ribs formed on the concave face. One die is movable along a track in the device which forms a path toward the other die. A screw urges the second die along the track to engage the first die and perform the crimping operation. The screw may be turned by a wrench. This disclosure has the shortcoming of slowly moving the dies toward one another and not being readily adjustable for different size fittings.

There is a considerable need for a device for expeditiously converting various hoses and fittings of a R-12 refrigeration system to a R-134a refrigeration system. The present invention provides a sealing and crimp locking device for retrofitting refrigeration systems and preventing leakage of refrigerant from the cooling system.

SUMMARY OF THE INVENTION

Briefly described, the present invention relates to an apparatus for crimping fittings to hose assemblies. Deflector rollers are positioned opposite of drive rollers. A fitting and hose combination is placed in contact with the deflector and drive rollers. During crimping, the drive rollers rotate the fitting. The deflector rollers include a raised portion in the surface thereof for forming a crimp in the rotating fitting. Preferably, the drive rollers and deflector rollers can be rotated by an interconnected gear system.

In a first embodiment, a power motor is used to drive the gear system. In an alternative embodiment, a gear handle is used to manually rotate the gears.

The deflector rollers are preferably attached to a slidably movable frame arm for adjusting the distance between the deflector rollers and the drive rollers, thereby allowing the apparatus to be used with a range of fitting sizes. A cam and follower roller arrangement can be coupled to the interconnected gear system for providing gradual penetration of the raised surface of the deflector rollers into the fittings. The depth of the crimp can be adjusted by adjusting the profile of the cam. Alternate shapes of the raised surface of the deflector roller, as well as the driver rollers, can be used to alter the shape of the crimp.

These and other features of the invention will be more fully understood by reference to the following drawings.

DETAILED DESCRIPTION OF THE INVENTION

During the course of the description like numbers will be used to identify like elements according to the different figures which illustrate the invention.

Figure 1:
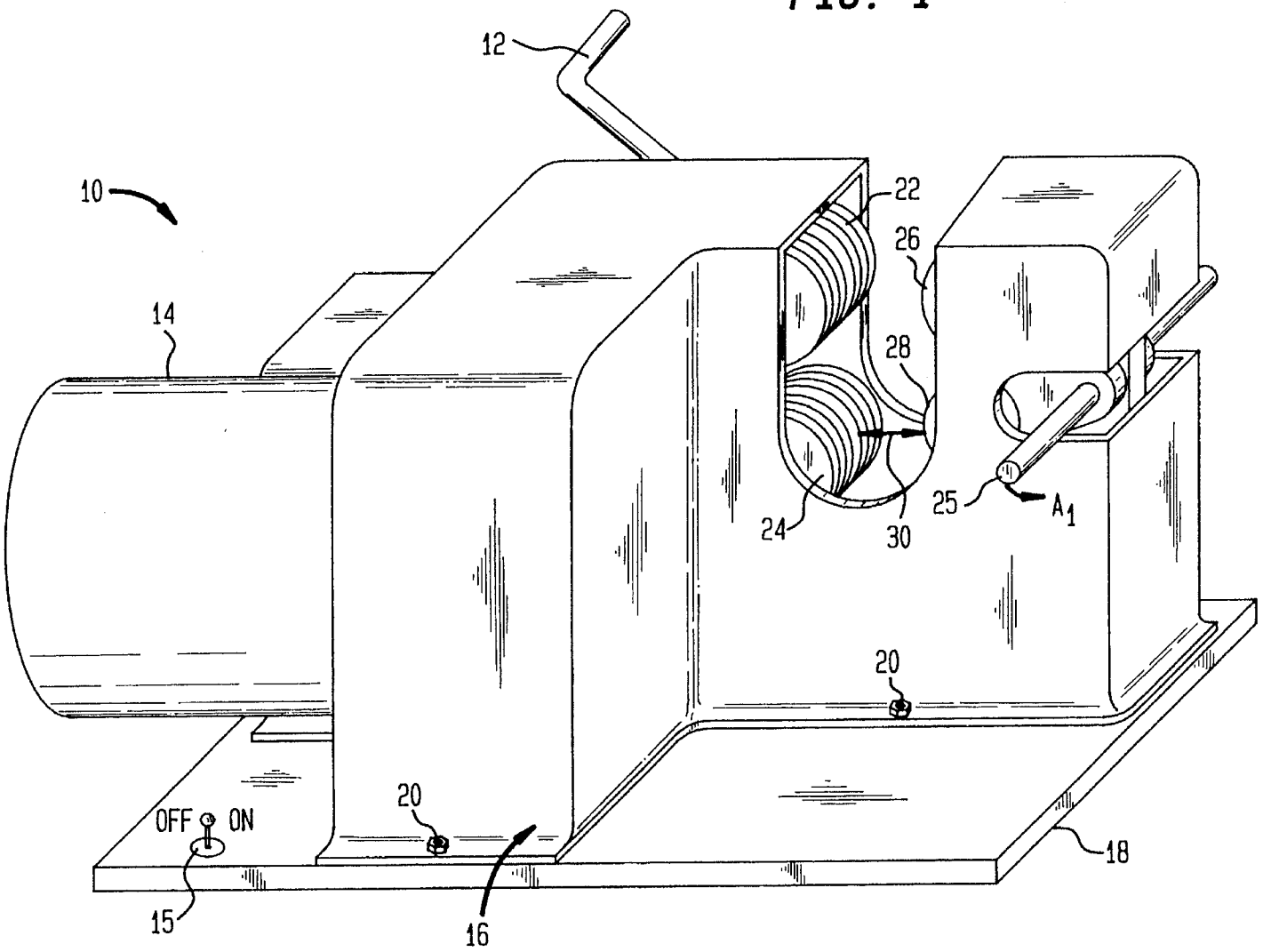
FIG. 1 is a side elevational view of a crimper apparatus in accordance with the teachings of the present invention.

FIG. 1 illustrates a side elevational view of crimper apparatus 10 in accordance with the teachings of the present invention. Crimper apparatus 10 can be operated in either a manually driven mode or a power driven mode. In the manually driven mode, handle 12 is rotated to drive crimper apparatus 10. In the power driven mode, motor 14 is activated to drive crimper apparatus 10. Power switch 15 turns motor 14 on and off. Motor 14 can be a conventional ⅓ hp motor with an rpm of 1725. Housing 16 is attached to base 18. Housing 16 can be attached to base 18 with bolts 20. In an alternative embodiment, base 18 can be a work bench or a table.

Crimp drive roller 22 and knurl drive roller 24 are positioned within housing 16. Deflector rollers 26 and 28 are positioned opposite of crimp drive roller 22 and knurl drive roller 24. Area 30 is the distance between knurl drive roller 24 and deflector roller 28 as well as the distance between crimp driver roller 22 and deflector roller 26. Handle 25 is pulled in the direction of arrow $A_1$ for increasing area 30 between knurl drive roller 24 and deflector roller 26.

It has been found that the positioning of knurl drive roller 24 below crimp drive roller 22 on the left hand side of deflector rollers 26 and 28 as shown in FIG. 1 has the advantage of providing crimping of fitting 32 without buckling. It has also been found that if the orientation of the knurl drive roller 24 is changed to be above crimp drive roller 22 or on the right hand side of deflector rollers 26 and 28 buckling of fitting 32 can occur.

Figure 2:
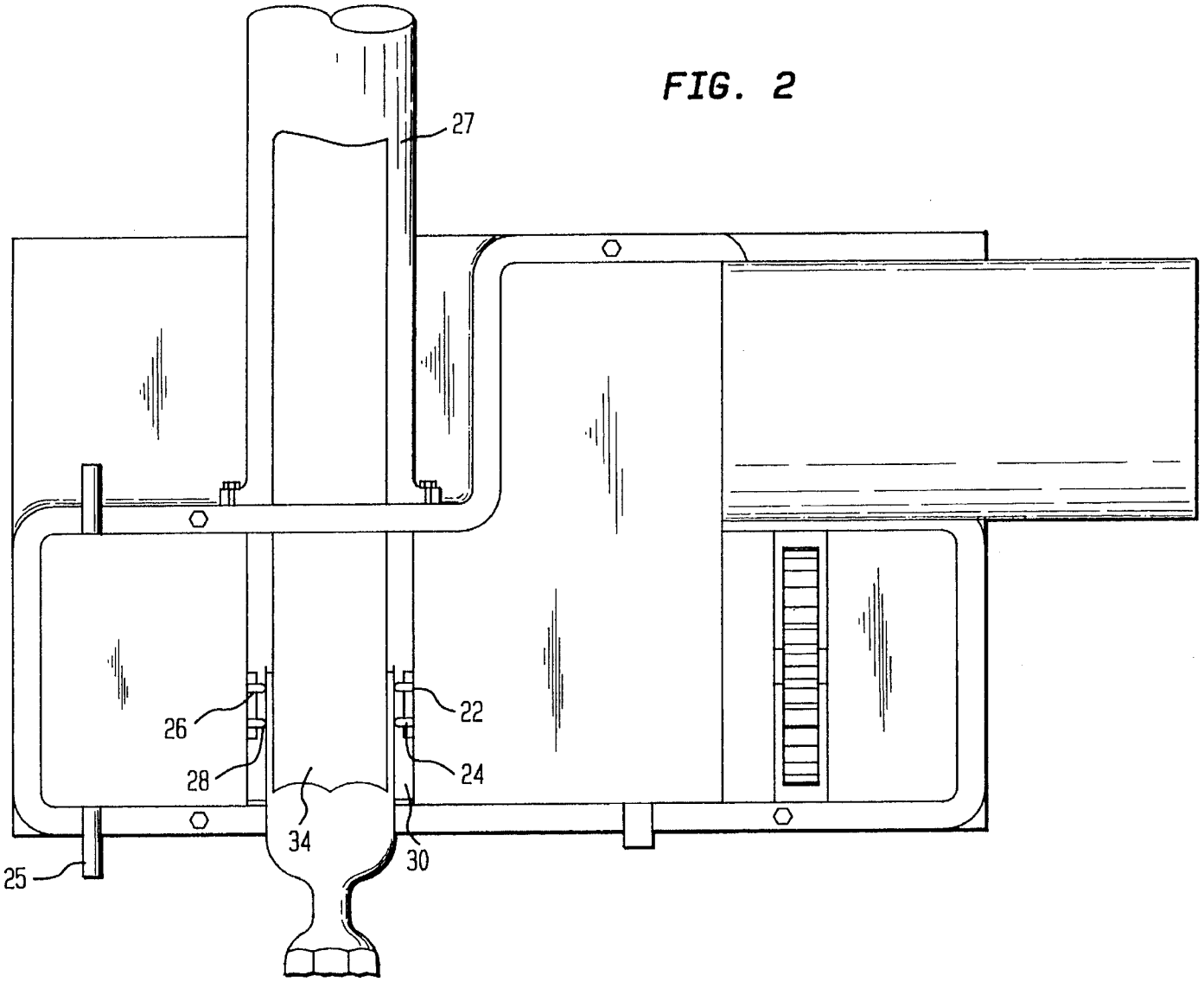
FIG. 2 is a top plan view from the rear of the crimper apparatus as shown in FIG. 1.

FIG. 2 is a top plan view of crimper apparatus 10 including a fitting and hose combination used in the crimper apparatus. Hose 34 is slidably inserted within fitting 32. Fitting 32 is positioned within area 30 among knurl drive roller 24, deflector roller 28, crimp drive roller 22 and deflector 26. Tube 27 can be placed over hose 34 and for supporting hose 34, thereby aiding in providing uniform rotation of hose 34. Preferably, crimper apparatus 10 is used with fittings and hoses which have a diameter in the range of from about 0.5 inches to about 3.0 inches. Preferably, fitting 32 and hose 34 conform to R134a standards. Area 30 can be adjusted with handle 25 to accommodate the various size hoses and fittings. It will be appreciated that larger or smaller fittings and hoses can be used in accordance with the teachings of the present invention.

Figure 3:
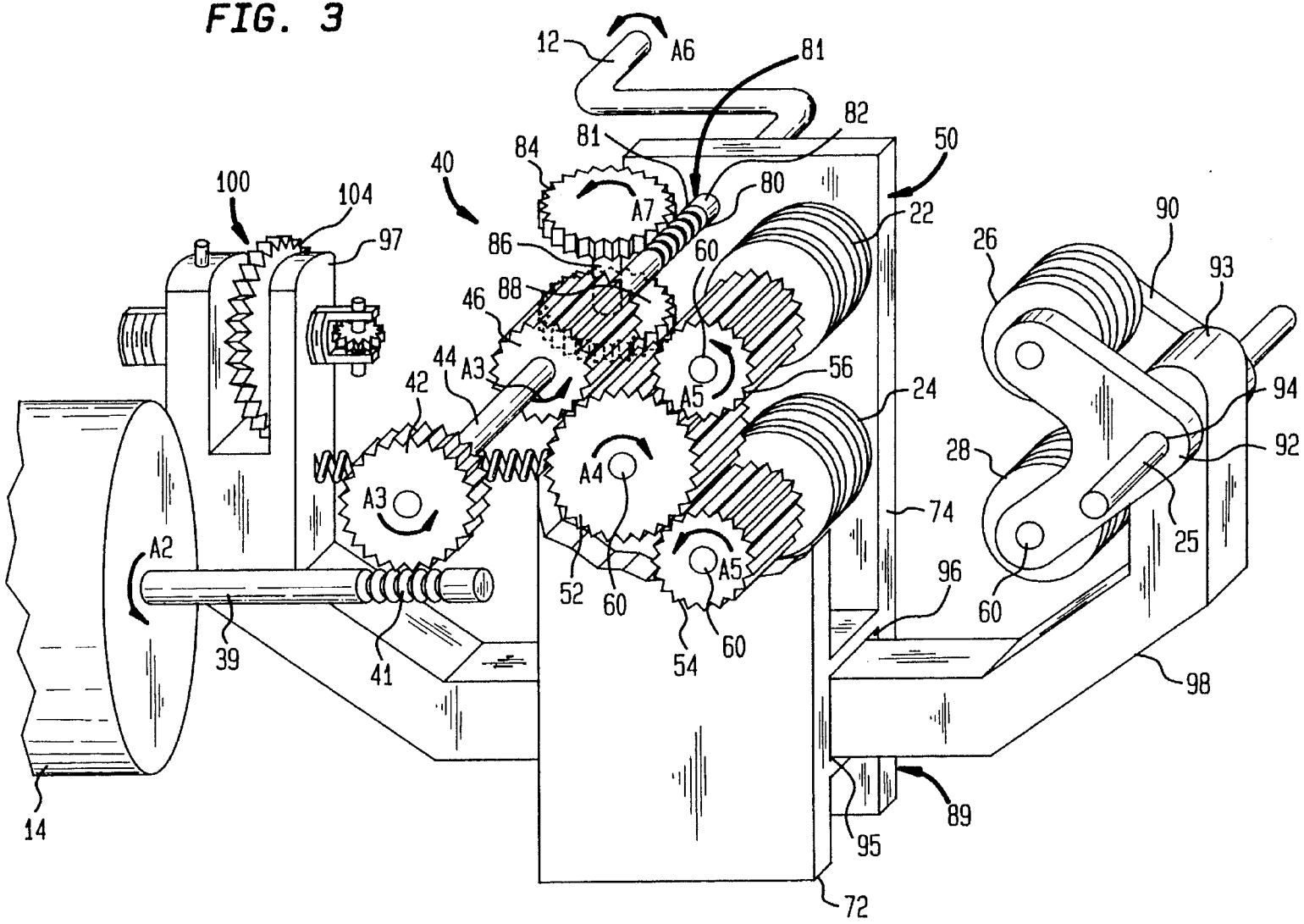
FIG. 3 is a side elevational view of the crimper apparatus with the housing removed.

FIG. 3 is a side elevational view of gear apparatus 40 for driving crimp drive roller 22 and knurl drive roller 24. Worm gear 42 includes a threaded portion 41. Motor output shaft 39 is coupled to threaded portion 41. Preferably, worm gear 42 has a reduction of 30:1. Shaft 44 connects worm gear 42 to spur gear 46. In this embodiment, motor 14 rotates motor output shaft 39 in a counterclockwise direction as shown by arrow $A_2$. Output shaft 39 in turn rotates worm gear 42 and spur gear 46 in a counterclockwise direction as shown by arrow $A_3$.

Spur gear 46 is coupled to an interconnected gear system 50. Interconnected gear system 50 includes gears 52, 54 and 56 with the reduction ratio of 1:1. Gear 52 contacts spur gear 46, gear 54 and gear 56. Gear 56 is connected to crimp drive roller 22 and gear 54 is connected to knurl drive roller 24. Gear 52 rotates in a clockwise direction shown by arrow $A_4$ for rotating gears 54 and 56 in a counterclockwise direction as shown by arrows $A_5$.

Gear 80 is positioned at end portion 82 of shaft 44. Gear 80 includes threaded portion 81. Shaft 44 extends through internal frame leg 74. Handle 12 is connected to end portion 82 of shaft 44. Worm gear 84 is coupled to gear 80. Shaft 86 connects worm gear 84 to cam 88. In the manual mode, handle 12 is rotated in a counterclockwise direction shown by arrow $A_6$ for rotating worm gear 84 in the direction of arrow $A_7$. Preferably, handle 12 is rotated at a speed of 60 rpm.

Frame 89 includes frame arm 98. Hinge 94 connects side plates 90 and 92 to end 93 of frame arm 98. Side plates 90 and 92 rotate around hinge 94. Deflector rollers 26 and 28 are connected to side plates 90 and 92. Preferably, side plates have a "v" shape. End 95 of frame arm 98 extends through opening 96 in frame 89. Frame arm 89 is slidably movable within opening 96 for moving end 93 of frame arm 98 towards or away from internal frame legs 72 and 74.

Figure 4:
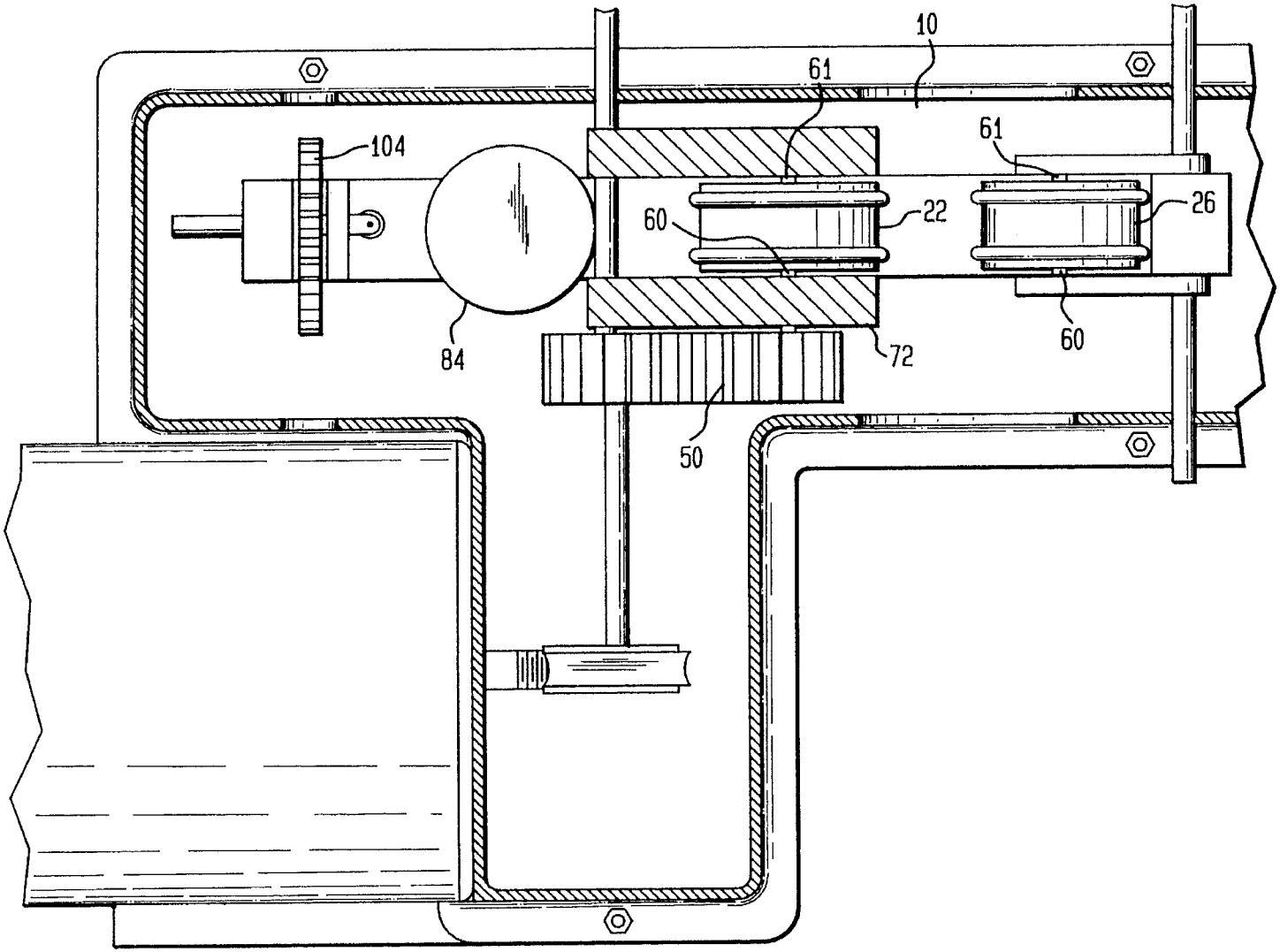
FIG. 4 is a horizontal cross-sectional view of the crimper apparatus shown in FIG. 3.

Interconnected gear system 50 is attached by bearing 60 to internal frame leg 72, as shown in FIG. 4. Crimp drive roller 22 and knurl drive roller 24 are attached to internal frame leg 74 with end 61 of bearing 60. Similarly, deflector rollers 26 and 28 are attached to internal frame leg 74 with end 61 of bearing 60.

Figure 5:
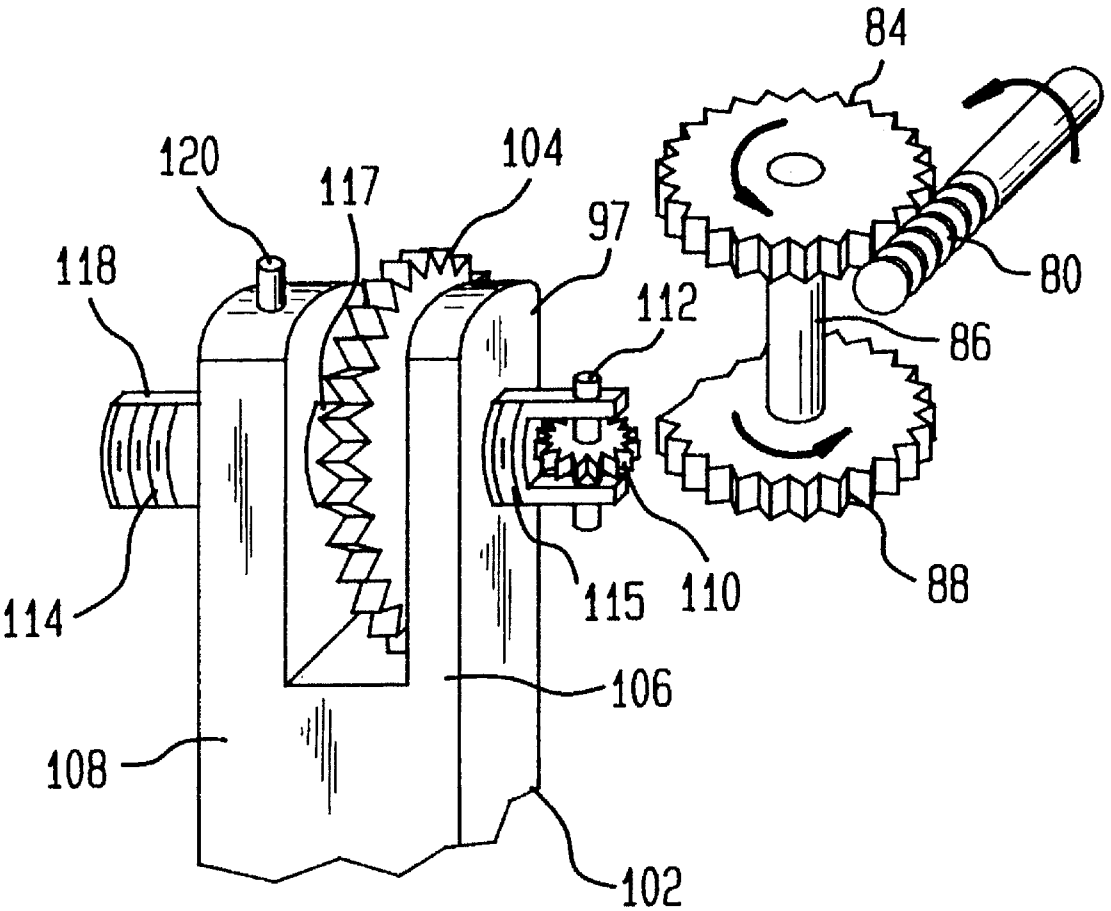
FIG. 5 is a perspective view of the cam/follower device and related dial and worm gear used in the crimper apparatus.

FIG. 5 is a perspective view of follower device 100. Yoke 102 is attached to end 97 of frame arm 98. Adjustable dial 104 is positioned between legs 106 and 108 of yoke 102. Follower roller 110 is attached with pin 112 to end 115 of adjustable guide screw 114. End 117 of adjustable guide screw 114 passes through adjustable dial 104. Key guide 118 is formed in end 117 of adjustable guide screw 114. When adjustable dial 104 is rotated, key guide 118 moves adjustable guide screw 114 in a forward or rearward direction. Adjustable dial 104 can be rotated in a clockwise or counterclockwise direction for respectively moving follower roller 110 in a forward or rearward direction. When adjusting with adjustable dial 104, pin 120 prevents guide screw 114 from rotating.

Figure 6:
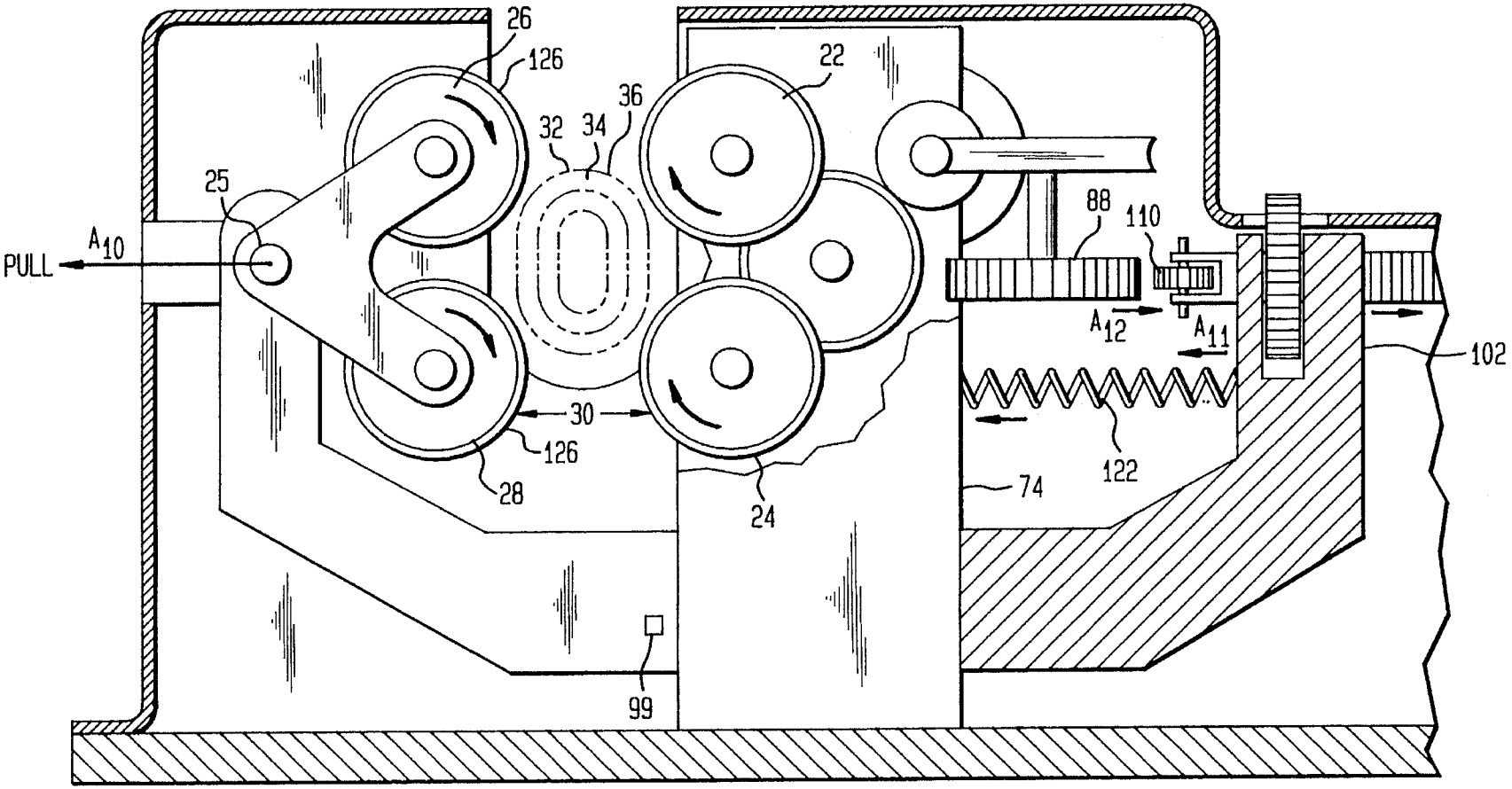
FIG. 6 is a side elevational cross-sectional view from the rear of the crimper apparatus during the crimping operation.

FIG. 6 is a cross sectional view of crimper apparatus 10 during set up and crimping operations. During set up, handle 25 is pulled in the direction of arrow $A_{10}$ to increase area 30. Spring 122 compresses to move yoke 102 towards internal frame leg 74 in the direction of arrow $A_{11}$. Fitting 32 and hose 34 are positioned in area 30. The outside surface 36 of fitting 32 contacts crimp drive roller 22, knurl drive roller 24 and deflector rollers 26 and 28. Spring 122 biases fitting 32 against crimper drive roller 22, knurl drive roller 24 and deflector rollers 26, 28 within area 30. Adjustable dial 104 is rotated for moving follower roller 110 into contact with cam 88.

To begin operation of crimper apparatus 10 in the power mode, power switch 15 is turned on. In the manual mode, handle 12 is rotated about fifteen times for about fifteen seconds. A fifteen second rotation of the handle 12 corresponds to a one complete rotation of cam 88.

In the power drive mode, motor output shaft 39 rotates worm gear 42, as shown in FIG. 3. Rotation of CAM 88 moves follower roller 110 in the linear direction of arrow $A_{12}$. Linear movement of follower roller 110 moves yoke 102 in the direction of arrow $A_{11}$, thereby moving deflector rollers 26 and 28 towards fitting 32 for providing additional crimping of fitting 32. During crimping, motion is transferred between worm gear 42, spur gear 46 and gears 52, 54 and 56. Respective gears 54 and 56 rotate knurl drive roller 24 and crimp drive roller 22. Spur gear 46 also transfers motion to gear 80 and cam 88. Crimp drive roller 22 and knurl drive roller 24 rotate fitting 32. Surface 126 of deflector roller 26 and surface 126 of deflector roller 28 contact outside surface 36 of fitting 32 for crimping fitting 32.

In the power driven mode, relay switch 99 measures the relative distance between internal frame leg 72 and end 97 of frame 89 for turning off motor 14. In the manually driven mode, a release position is felt by release of the load on handle 12. After crimping of fitting 32, handle 25 can be moved in the direction of arrow $A_{10}$ for releasing fitting 32.

Thereafter, fitting 32 can be removed from crimper apparatus 10.

Figure 7B:
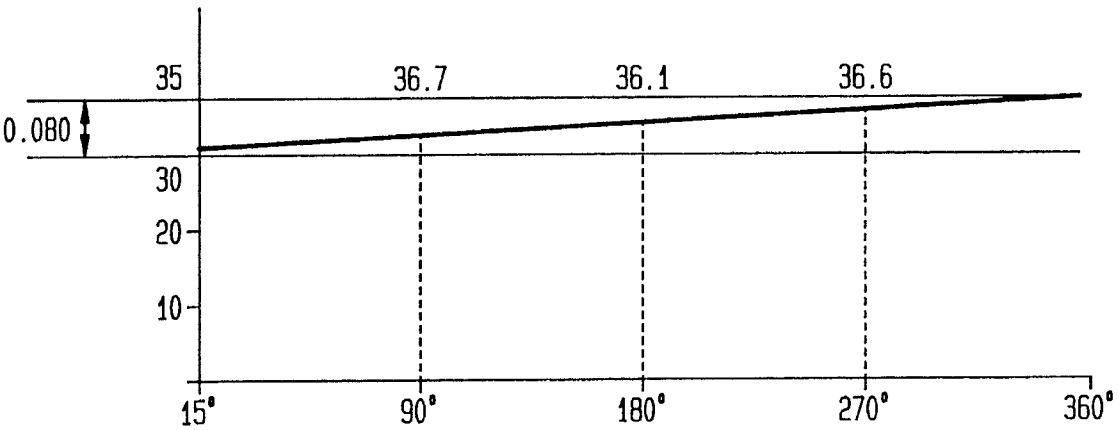
FIG. 7B is a graph of the cams profile, follower displacement labelled R versus the rotation of the cam in degrees.
Figure 7A:
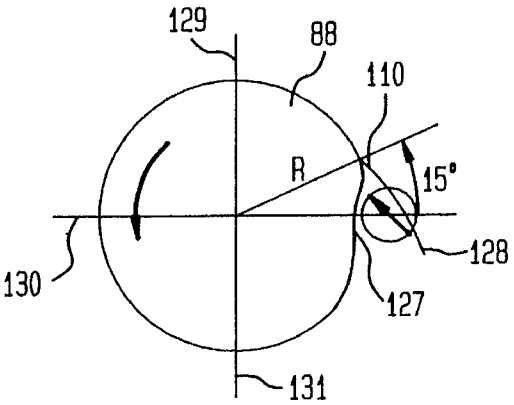
FIG. 7A is a top view of the cam and follower roller used in the crimper apparatus.

FIG. 7A is a top view of cam 88 and follower roller 110. Cam 88 has an indentation at release position 127. Before crimping, follower roller 110 is positioned at release position 127 by rotating dial 104. Cam 88 rotates 360° in a counterclockwise direction during crimping of fitting 32. After crimping is complete, cam 88 is returned to release position 127. Linear movement of follower 110 is shown in FIG. 7B. Preferably, the profile of cam 88 provides a linear path with small slope for follower roller 110 with a maximum displacement of about 0.08 inches, as shown in FIG. 7B.

In this embodiment, the starting point of follower roller 110 is at release position 127 or at zero degrees. As cam 88 rotates counterclockwise, follower roller 110 passes through point 131 (90°), point 130 (180°), point 129 (270°) and point 128 (345°). The roller's movement from release position 127 to points 131, 130, 129 and 128 is linear as shown in the graph of FIG. 7B. After point 128, follower roller 110 has negative displacement and linearly goes back to its release position 127. Total positive displacement of the follower is about 0.08 inches which is equal to the depth of the crimp on the fitting. The depth of the crimp on fitting 32 can be adjusted, if so desired, by changing the initial contact point of the follower roller 110 and cam 88.

In alternate embodiments, the starting point of follower roller 110 can be altered by a partial rotation of handle 12 or motor output shaft 39 to advance the starting point to points 131, 130, or 129 to achieve more or less crimped depth. The depth of the crimp can be increased or decreased by the following procedures. To increase the depth of the crimp, after one rotation of cam 88, cam 88 is rotated manually by handle 12 or motor 14, so that follower roller 110 aligns with cam 88 at either points 129, 130, 131. Thereafter, dial 104 is rotated until follower roller 110 contacts the desired point. Afterwards, motor 14 is turned on or handle 12 is rotated manually until the rotation of cam 88 is complete, i.e., follower roller 110 is at release position 127. To reduce the depth, the initial starting point is changed from release position 127 to any one of points 131, 130 or 129, motor is turned on or the handle is rotated manually until cam 88 returns to release position 127.

Figure 8B:
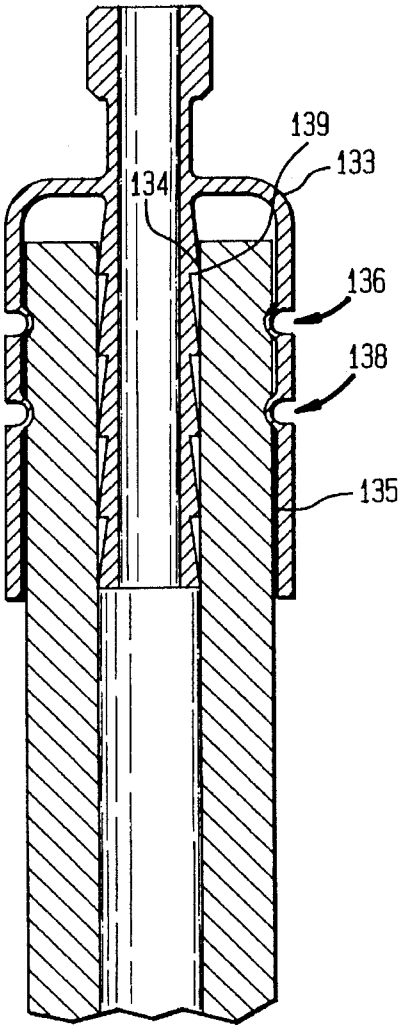
FIG. 8B is a cross-sectional view of a fitting and hose after the crimping operation.
Figure 8A:
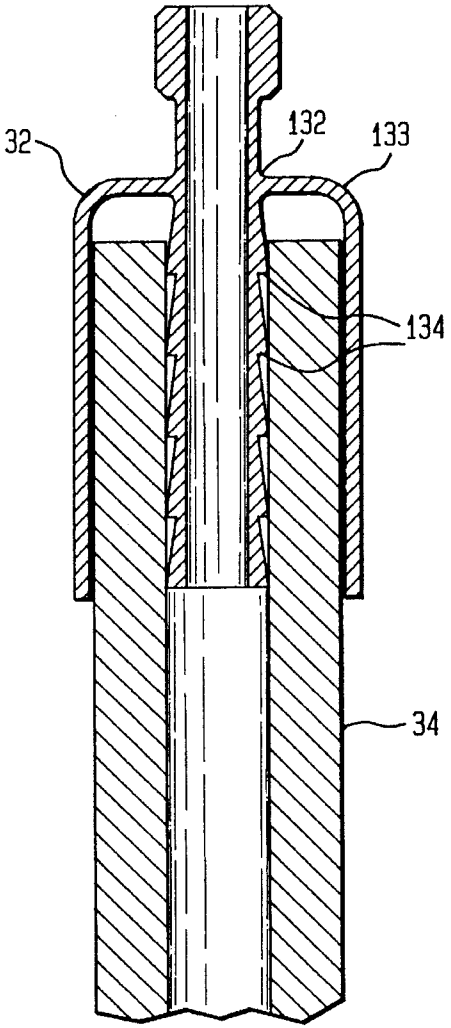
FIG. 8A is a cross-sectional view of a fitting and hose before the crimping operation.

FIG. 8A is a cross sectional view of fitting 32 and hose 34 before crimping. Fitting 32 includes tube 133 and center portion 132. Center portion 132 includes grooves 134 along the length thereof. Hose 34 is inserted within fitting 32 over grooves 134. FIG. 8B is a cross sectional view of fitting 32 and hose 34 after crimping. Crimps 136 and 138 are formed on the outside surface 135 of tube 133. Crimps 136 and 138 force portion 139 of hose 34 into grooves 134 for providing a leak free connection between fitting 32 and hose 34.

Figure 9A:
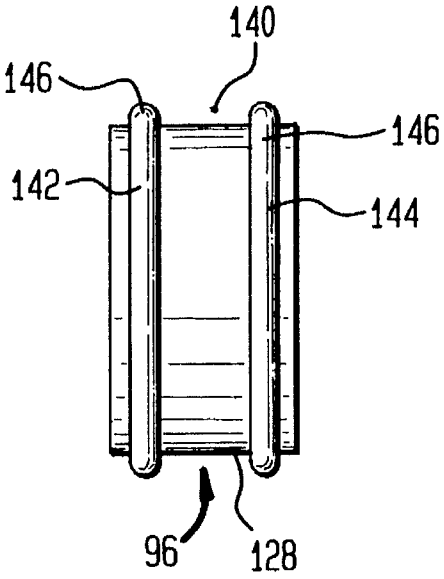
FIG. 9A is a top view of a deflector roller used in the crimper apparatus.
Figure 9D:
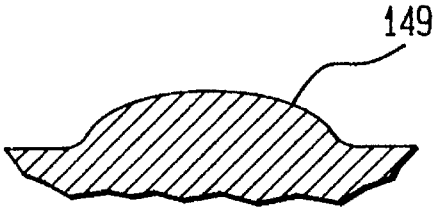
FIG. 9D is a cross-sectional view of a elliptical raised portion formed in the deflector rollers and the drive rollers.
Figure 9B:
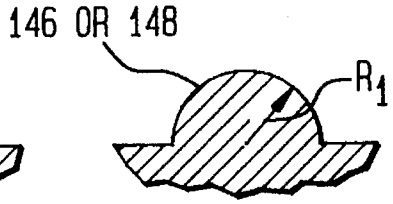
FIG. 9B is a cross-sectional view of a curved raised portion formed in the deflector rollers and the drive rollers shown in FIG. 9A.

FIG. 9A is a top view of deflector rollers 26 and 28. Top surface 140 of deflector rollers 26, 28 includes at least one raised portion 142. Depending on the desired number of crimps one can have up to four raised portions 142. Preferably, deflector roller 26 has a pair of raised portions 142 and 144. Raised portions 142 and 144 can have respective curved top portions 146 and 148 with a radius $R_1$, as shown in FIG. 9B. Preferably, radius $R_1$ is between about 0.020 and about 0.20 inches. Most, preferably radius $R_1$ is about 0.045 inches. Raised portions 142 and 144 form crimps 136 and 138 in fitting 32 with a curved shape, as shown in FIG. 8B. In alternate embodiments, additional raised portions can be formed in deflector rollers 26 and 28 for forming additional crimps in fitting 32.

Figure 9C:
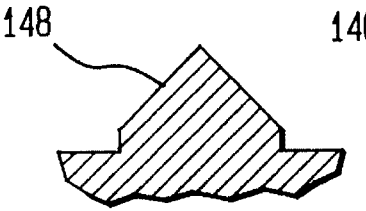
FIG. 9C is a cross-sectional view of a conical raised portion formed in the deflector rollers and the drive rollers.

Alternatively, raised portions 142 and 144 of deflector rollers 26, 28 can have a conical portion 148, as shown in FIG. 9C. In the alternative, raised portion 142 and 144 can have an elliptical portion 149, as shown in FIG. 9D. Conical portion 148 and elliptical portion 149 form respective conical or elliptical crimps in fitting 32.

Figure 10A:
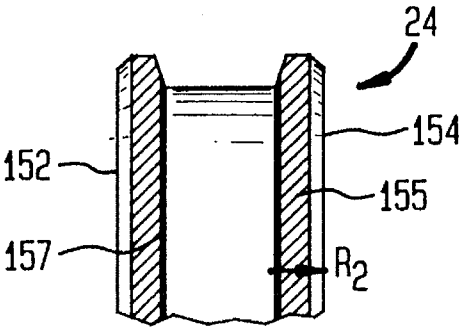
FIG. 10A is a top view of a knurl drive roller used in the crimper apparatus.
Figure 10B:
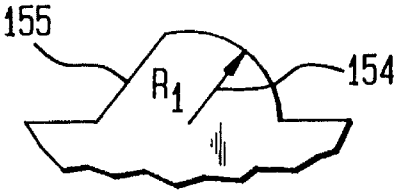
FIG. 10B is a cross-sectional view of the knurl drive roller.

FIG. 10A is a top view of knurl drive roller 24. Knurl drive roller 24 includes raised portions 152 and 154. Inner portions 155 and 157 of respective raised portions 152 and 154 are knurled. Inner portions 155 and 157 eliminate slippage between knurl drive roller 24 and fitting 32. FIG. 10B is a cross-sectional view of raised portion 154 and inner portion 155. Preferably, raised portions 152 and 154 have a radius $R_2$ between about 0.02 and 0.30 inches. Most preferably, knurl drive roller has a radius $R_2$ of about 0.067 inches.

Figure 11:
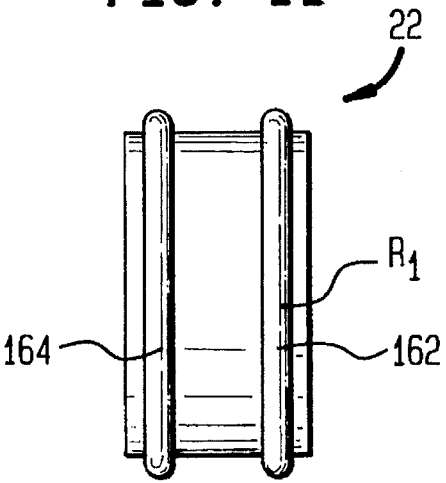
FIG. 11 is a top view of a crimp drive roller used in the crimper apparatus.

FIG. 11 is a top view of crimp drive roller 22. Crimp drive roller 22 includes raised portions 162 and 164. Preferably, raised portions 162 and 164 are curved and have a radius $R_3$ between about 0.02 and 0.30 inches. Most preferably, raised portions 162 and 164 have a radius $R_3$ of about 0.067 inches. When one, two, three or four crimps are desired on fitting 32 respectively, one, two, three or four raised portions of crimp drive roller 22 and knurl drive roller 24 and deflector rollers 26 and 28 are provided.

The present invention has the advantage of expeditiously crimping a fitting to a hose. Preferably, a leakproof double crimp is formed in the fitting for providing a leakproof connection of the hose to the fitting. The present invention can be readily adjusted to accommodate various sized fittings and hoses. Different shaped crimps can be obtained by altering the shape of deflector rollers which crimp the fitting.

While the invention has been described with reference to the preferred embodiment thereof, it will be appreciated by those of ordinary skill in the art that modifications can be made to the structure and form of the invention without departing from the spirit and scope thereof.

We claim:

1. A crimper apparatus for securing a fitting to a hose comprising:

drive roller means for rotating said fitting;

gear means for rotating said drive roller means;

cam means coupled to said gear means, said cam means being rotated by said gear means;

deflector roller means positioned opposite of said drive roller means, said deflector roller means having at least one raised portion on the outside surface thereof, said raised portion contacting said fitting, thereby crimping said fitting; and follower means positioned opposite of said cam means, said follower means contacting said cam means during formation of said crimp for moving said cam means in a linear direction, wherein said cam means has a profile which provides a linear path with small slope for said follower roller for gradually moving said drive roller means toward said deflector roller means.

2. The crimper apparatus of claim 1 further comprising:

a frame, said drive roller means attached to said frame;

a frame arm slidable within said frame, said deflector roller means attached to said slidable frame arm, wherein said deflector roller means is moveable towards and away from said drive roller means.

3. The crimper apparatus of claim 2 wherein said follower means comprises:

a follower roller; and an adjustable dial for adjusting the distance between said follower roller and said cam means.

4. The crimper apparatus of claim 3 wherein said drive means comprises:

a knurl drive roller attached to said frame, said knurl drive roller having a raised portion, said raised portion being knurled on an inner portion thereof; and a crimp drive roller attached to said frame above said knurl roller.

5. A crimper apparatus for securing a fitting to a hose comprising:

a frame;

a knurl drive roller attached to said frame, said knurl drive roller having a raised portion, said raised portion being knurled on an inner surface thereof and a crimp drive roller attached to said frame above said knurl roller, said crimp drive roller and said knurl drive roller rotating said fitting;

gear means for rotating said knurl drive roller and said crimp drive roller;

deflector roller means positioned opposite of said knurl drive roller and said crimp drive roller, said deflector roller means having at least one raised portion on the outside surface thereof, said raised portion contacting said fitting for crimping said fitting;

a frame arm slidable within said frame, said deflector roller means attached to said slidable frame arm, said deflector roller means is moveable towards and away from said crimp drive roller and said knurl drive roller;

cam means coupled to said gear means, said cam means being rotated by said gear means;

follower roller positioned opposite of said cam means, said follower roller contacting said cam means during formation of said crimp for moving said cam means in a linear direction for gradually moving said knurl drive roller and said crimp drive roller toward said deflector roller means;

an adjustable dial for adjusting the distance between said follower roller and said cam means;

a first gear coupled to said knurl drive roller;

a second gear coupled to said crimp drive roller;

a third gear coupled to said first and second gears;

a spur gear coupled to said third gear; and a first worm gear coupled to said spur gear, wherein rotation of said first worm gear rotates said first, second and third gears.

6. The crimper apparatus of claim 5 wherein said cam includes an indentation at a release position.

7. The crimper apparatus of claim 6 wherein said follower roller is positioned opposite of said indentation before said securing said fitting to said hose.

8. The crimper apparatus of claim 6 wherein said follower roller is positioned at a position selected from the group of 90° , 180° and 270° from said release position.

9. The crimper apparatus of claim 6 wherein said first and second gears rotate in a counterclockwise direction, said third gear rotates in a clockwise direction, said spur gear rotates in a counterclockwise direction and said first worm gear rotates in a counterclockwise direction.

10. The crimper apparatus of claim 6 wherein each of said deflector rollers has a pair of said raised portions.

11. The crimper apparatus of claim 6 wherein said first worm gear is connected to power means.

12. The crimper apparatus of claim 6 further comprising:

a second worm gear coupled to said spur gear; and a handle coupled to said second worm gear, wherein rotation of said handle rotates said spur gear.

13. The crimper apparatus of claim 6 wherein said raised portions of said deflector rollers have a curved shape.

14. The crimper apparatus of claim 6 wherein said raised portions of said deflector rollers have a conical shape.

15. The crimper apparatus of claim 6 wherein said raised portions of said deflector rollers have an elliptical shape.

16. The crimper apparatus of claim 6 further comprising:

a tube for receiving said hose, said tube supporting said hose during said securing of said fitting to said hose.

17. The crimper apparatus of claim 6 wherein said raised portion has a radius of between about 0.02 and about 0.3 inches.

* * * * *